US007261070B2

(12) United States Patent
Jones et al.

(10) Patent No.: US 7,261,070 B2
(45) Date of Patent: Aug. 28, 2007

(54) LINEAR FLUID ENGINE

(76) Inventors: James W. Jones, P.O. Box 96, 578 Route 244, Alfred Station, NY (US) 14803-0096; Leon Dale Cole, 8343 Route 59, Lewis Run, PA (US) 16738

( * ) Notice: Subject to any disclaimer, the term of this patent is extended or adjusted under 35 U.S.C. 154(b) by 214 days.

(21) Appl. No.: 11/231,664

(22) Filed: Sep. 21, 2005

(65) Prior Publication Data

US 2006/0196454 A1 Sep. 7, 2006

(51) Int. Cl.
*F04B 17/00* (2006.01)

(52) U.S. Cl. ..... 123/46 SC

(58) Field of Classification Search ..... 123/46 SC, 123/46 R

See application file for complete search history.

(56) References Cited

U.S. PATENT DOCUMENTS 5,287,827 A * 2/1994 Almendinger et al. .... 123/46 R
5,482,445 A * 1/1996 Achten et al. ..... 417/362
5,913,290 A * 6/1999 Kvamsdal et al. ..... 123/46 R
6,076,506 A * 6/2000 Berlinger et al. ..... 123/46 SC
6,135,069 A * 10/2000 Fenelon et al. ..... 123/46 R
6,158,401 A * 12/2000 Bailey ..... 123/46 SC
6,205,961 B1 * 3/2001 Bailey et al. ..... 123/46 R
6,279,517 B1 * 8/2001 Achten ..... 123/46 R

* cited by examiner

*Primary Examiner*—Stephen K. Cronin
*Assistant Examiner*—Jason Benton
(74) *Attorney, Agent, or Firm*—Calfee Halter & Griswold

(57) ABSTRACT

A linear fluid engine includes a power transfer cylinder that is driven by combustion of fuel in a combustion cylinder to pressurize a power transferring fluid. Some of the power transferring fluid is used to power a subsequent compression stroke in the combustion cylinder and, optionally, the intake/exhaust valves on the cylinder. A controller controls the compression stroke and intake/exhaust valve operation based on a stored control algorithm.

28 Claims, 6 Drawing Sheets

LINEAR FLUID ENGINE

TECHNICAL FIELD

The invention relates generally to the field of internal combustion engines and alternative fuel engines.

BACKGROUND

The basic design of the conventional piston internal combustion engine (ICE) has changed little since its inception about 120 years ago. The piston ICE is often referred to as a "heat engine," because it derives its energy from heat. Steam, gasoline, and diesel fuel all have been used to power this engine. In the 1970's, there was concern over the dwindling supply of non-renewable fossil fuels. This, together with the threat of increasing pollution, sparked an interest in exploring alternate sources of energy. Some improvements have been made in efficiency (power per pound of fuel) as well as attempts to decrease harmful emissions. They have occurred largely due to the application of computers to monitor and control various engine parameters.

By its design, the piston ICE does not allow for continually variable piston stroke or velocity, nor does it accommodate variable intake and exhaust valve timing since these parts are mechanically linked. Due to its design, the power piston is not in a position to impart torque to the crankshaft most of the time. Though not available when basic piston engines were conceived, System Control Computers (SCCs) are commonly used today. Extremely accurate position, pressure and temperature sensors as well as efficient fluid motors and linear actuators and associated electronic controls are "off the shelf" items now. Due to the design of the conventional piston ICE, there are limitations in how much more computers can do to improve this engine.

SUMMARY

A Linear Fluid Engine (LFE) constructed in accordance with the present invention can make maximum use of the SCC to provide flexibility in the interaction of the LFE internally aligned components to minimize vibration, improve efficiency, lower environmental pollution, and utilize effectively a variety of fuels. It has the unique ability to vary the stroke length at any time, vary its piston speed during a stroke and incorporates fully variable ignition and valve timing. In effect, the LFE can vary its size to suit the load requirements. The SCC software can adapt it to use less conventional fuels, less costly low octane fuels and new fuels being developed.

Accordingly, a linear fluid engine includes an engine cylinder that houses an engine piston within a combustion chamber and a fluid power piston coupled to the engine piston and housed within a power piston cylinder. The power piston is driven by movement of the engine piston caused by the combustion of fuel and, for example, fresh air, in the combustion chamber. When the power piston is driven by the engine piston, the power piston acts upon fluid within the power piston cylinder to transfer power from the engine cylinder out of the linear fluid engine.

Advantageously, a fluid compression piston that is powered by the power piston can be coupled to the engine piston that drives the engine piston within the combustion chamber to compress fuel in preparation for the combustion of the fuel within the combustion chamber. A fluid intake/exhaust piston that is also powered by the power piston can be coupled to the engine piston that drives the engine piston within the combustion chamber to exhaust combustion gases and intake fresh air in preparation for a next combustion cycle. One or more accumulating tanks can be placed in fluid communication with any or all of the pistons so that each tank is maintained within a predetermined range of pressures.

In one construction, the engine piston includes an engine piston head and an engine piston shaft. The power piston includes a power piston head and a power piston shaft and the power piston head and shaft are formed on a moveable sleeve disposed around the engine piston shaft that by seals allows a slip over the engine piston shaft. The sleeve includes a top distal end that is configured to abut an underside of the engine piston head to drive or be driven by the engine piston. The centerline of the engine piston can advantageously be located substantially coincident with a centerline of the power piston.

A plurality of valves regulates fluid flow into and out of the accumulating tanks to maintain the pressure of the tanks and to selectively power devices that are driven by the linear fluid engine as well as devices required for LFE operation. A SCC can actuate one or more components based on a control algorithm that is stored in the SCC memory.

In addition, a method for powering engine driven components with a power transferring fluid includes combusting fuel in an engine cylinder with an engine piston; driving a power cylinder with the power generated by the combustion of fuel in the engine cylinder to pressurize the power transferring fluid; and, with the pressurized power transferring fluid, driving a compression piston that is coupled to the engine piston to compress fuel for a subsequent combustion of fuel.

According to another feature, a valve control system for use with a combustion engine includes one or more intake/exhaust valves that selectively place a cylinder of the combustion engine in communication with atmospheric conditions. The valve control system includes a fluid valve control piston coupled to each intake/exhaust valve of the combustion engine that is driven by pressurized fluid to actuate the intake/exhaust valve. Alternatively, the valve control system includes a stepper motor coupled to the intake/exhaust valve of the combustion engine that actuates the intake/exhaust valve.

DETAILED DESCRIPTION

When constructed in accordance with the described embodiment, a LFE eliminates the crankshaft and camshaft found in conventional piston engines and there is a straight-line push on all pistons. The operating characteristics of the LFE can be varied easily using the SCC because its characteristics are not locked in by the geometric configuration of a crankshaft or camshaft. Instead, each moving part is independent of the others. A state of the art SCC controls engine functions to optimize engine efficiency over a wide range of engine speeds, power output, fuel types and atmospheric conditions.

In the described embodiment, the LFE minimizes weight by not using a crankshaft, connecting rods or camshaft. In place of these mechanically interlocked components, the SCC controls fluid piston operation, including intake and exhaust valves and other components of the LFE. The SCC controls fluid valves to route the fluid to the proper location in the system at the proper time during the engine cycle. The fluid pistons, fluid motors and linear actuators do not necessarily need to be located in close proximity to the LFE, adding additional flexibility to the design. Energy is extracted from the LFE by way of a fluid. This fluid can supply fluid motors, actuators, etc. to power a vehicle or machine.

Figure 1:
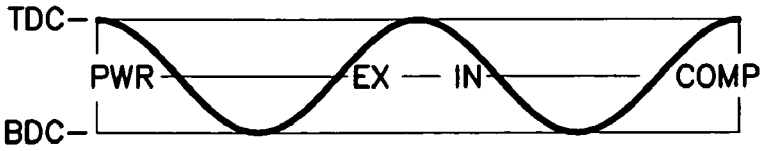
Fig.1 PRIOR ART
FIG. 1 is a graphic depiction of one cycle of a conventional four-cycle piston ICE.
Figure 2:
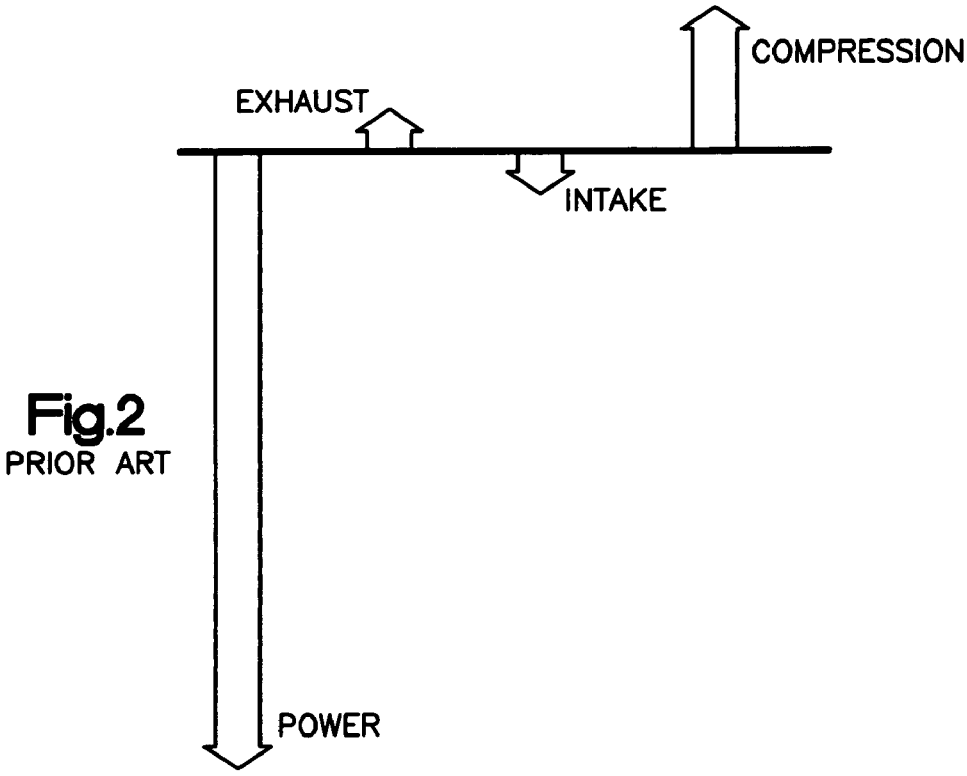
Fig.2 PRIOR ART
FIG. 2 is a schematic representation of relative forces acting on a piston in a conventional four-cycle engine during one cycle.

Referring now to FIG. 1, one cycle of a piston in a conventional four-cycle ICE is shown. The graph labels are the power (pwr), exhaust (ex), intake (in), and compression stroke (comp). TDC is the position at which the piston is at the top dead center and at BDC it is at the bottom dead center. The ICE piston is forced into this fixed cyclic motion by the crankshaft. The relative forces acting on the piston and their direction are shown in FIG. 2 for one cycle. The lengths of the arrows shown in FIG. 2 are diagrammatic only and not to actual scale. The smallest forces are the exhaust and intake valve forces that act in opposite directions on the piston. The compression force is several times larger than the exhaust and intake forces. The compression, exhaust, and intake forces represent engine losses because they do not produce useful power output. These losses, together with losses such as friction or heat, must be subtracted from the power generated by the power stroke.

Figure 3:
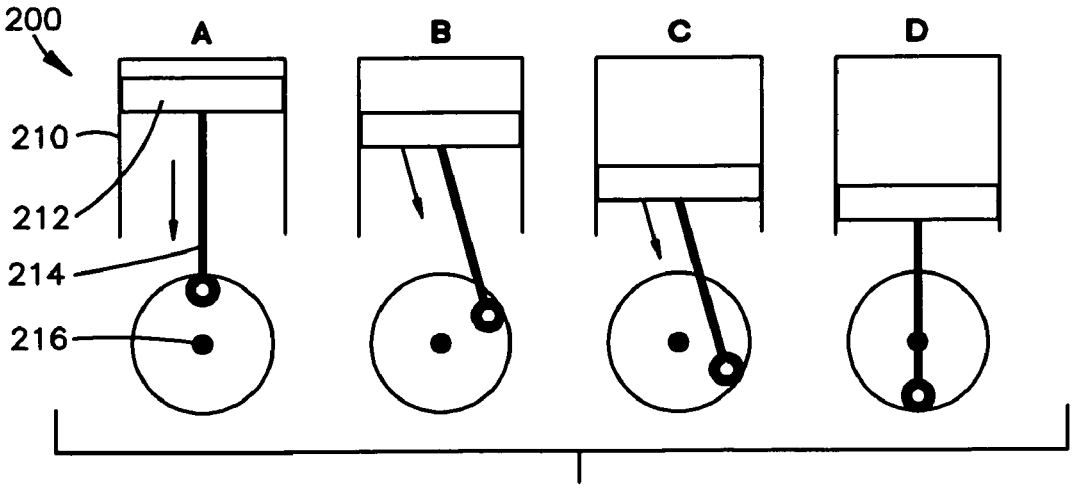
Fig.3 PRIOR ART
FIG. 3 is a schematic representation of the relative position of a piston as it is moved through one power stroke cycle of a conventional four-cycle engine.

FIG. 3 illustrates the four positions of the piston 212 in a single engine cylinder 210 of a conventional four-cycle engine 200 during a power stroke. Any downward combustion force provides a torque to the crankshaft 216 only at positions "B" and "C." No torque can be produced at TDC or BDC. Very little torque can be generated just after TDC or before BDC because of the crankshaft's position. Even at "B" and "C" the angle of the connecting rod 214 does not allow the full downward force of the piston to be transferred to the crankshaft. Between TDC and BDC some of the piston's downward force develops a sidewall force due to the angle of the connecting rod.

Figure 4:
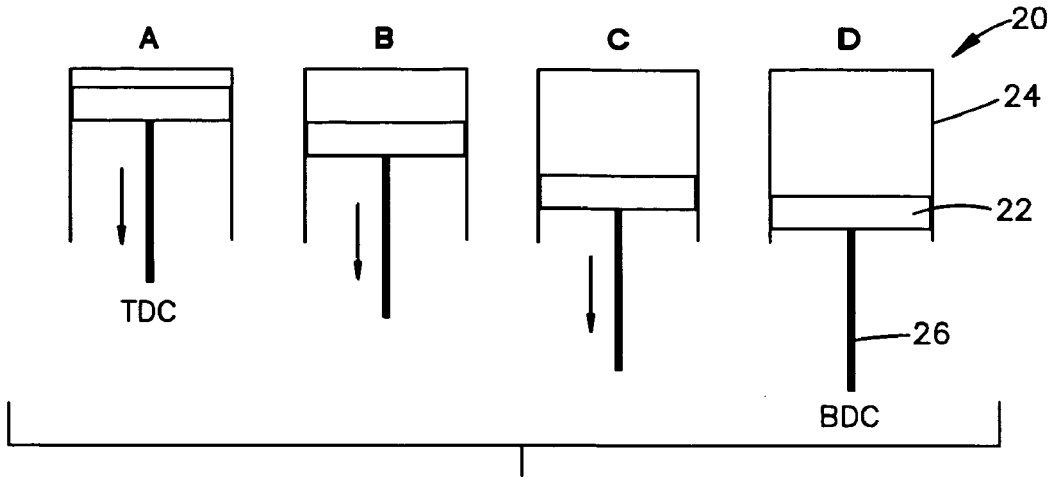
FIG. 4 is a schematic representation of the relative position of a piston as it is moved through one power stroke cycle of a LFE constructed in accordance with an embodiment of the present invention.

FIG. 4 illustrates the four positions of an engine piston 22 in a cylinder 24 of a modified ICE 20 during the power stroke. The engine piston 22 is directly connected to the fluid pistons of a LFE (shown in FIG. 5). The engine piston 22, a connecting rod 26, and the LFE fluid pistons are all in alignment. Any combustion force produces output power in Figures "A", "B" and "C." Because the connecting rod 26 is aligned with the piston 22, all combustion force on the piston is entirely available as power output from TDC to just before the selected BDC is reached. There is little or no downward force developing a sidewall force because the connecting rod is always in alignment with the piston. Since the LFE has no crankshaft the length of the power stroke can be changed if required by the control program in the SCC.

Figures 5, 6, 7:
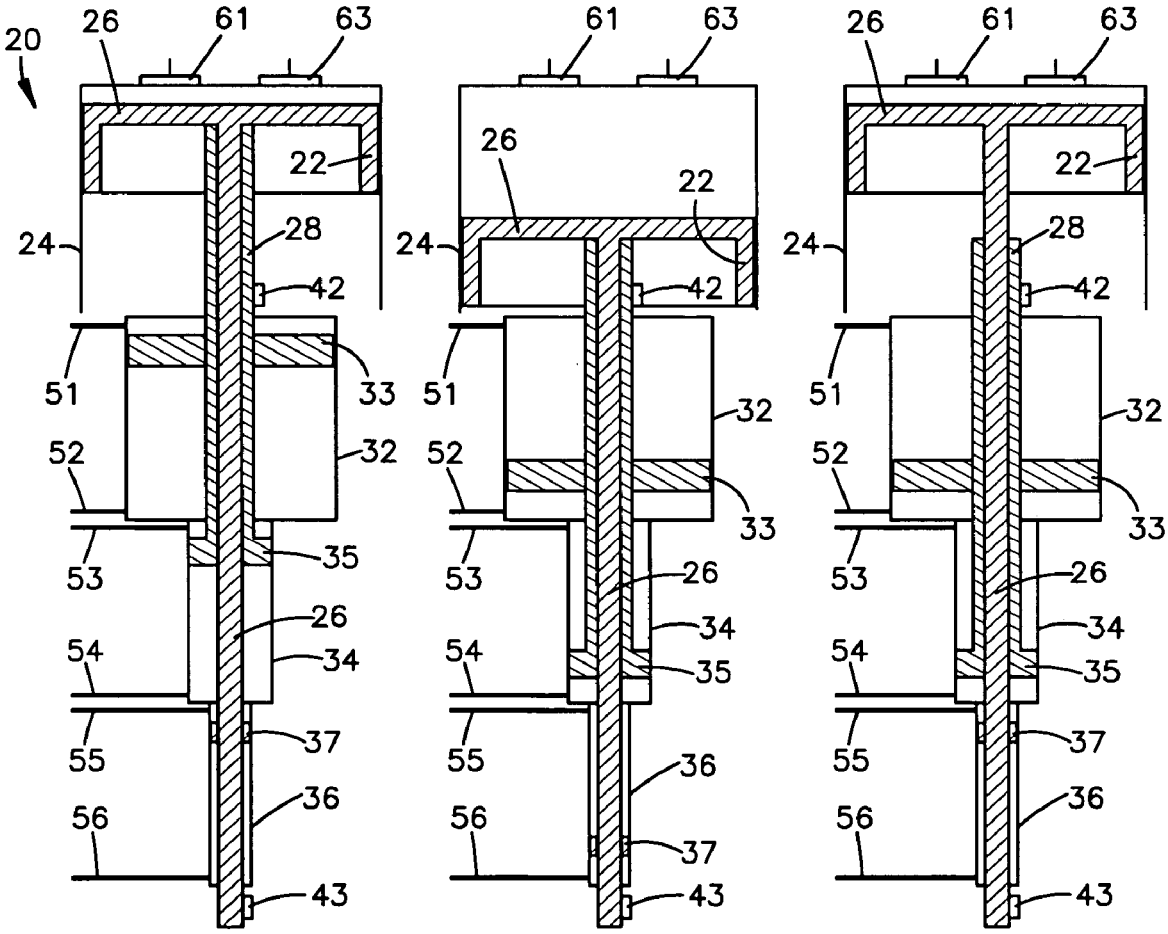
FIGS. 5-7 are schematic illustrations of one cylinder assembly at various points during one cycle of a LFE constructed in accordance with an embodiment of the present invention.

FIG. 5 schematically illustrates a single engine cylinder assembly 24 in a LFE 20. The engine cylinder 24 is similar to a cylinder in a convention ICE. The cylinder 24 includes exhaust valve 61 and intake valve 63. Opening and closing the exhaust and intake valves are independently controlled by the SCC as will be described in more detail below.

Figure 17:
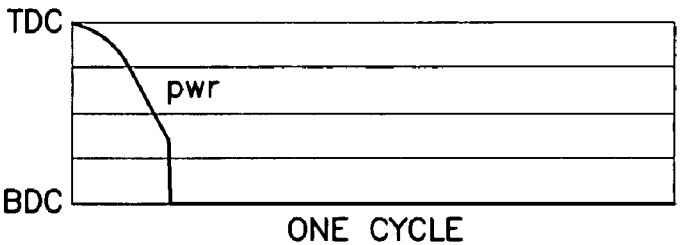
FIG. 17 is a graphic depiction of the fluid pressure produced by the primary fluid piston during one cycle of a LFE constructed in accordance with an alternative embodiment of the present invention.

The cylinder assembly 24 houses the engine piston 22, which can be similar in size and geometry to a piston in a conventional ICE. The engine piston is connected to a set of three fluid pistons including a power piston 33, a compression piston 35, and an exhaust/intake piston 37. The pistons are housed in a power cylinder 32, compression cylinder 34, and exhaust/intake cylinder 36, respectively. Each cylinder has a pair of input/output (I/O) fluid lines 51 and 52, 53 and 54, and 55 and 56. The fluid lines are selectively connected to a set of fluid tanks (FIG. 17) and other devices through control valves that are opened and closed at the appropriate time in the LFE cycle by the program in the SCC.

The engine piston 22 and the set of fluid pistons are formed by two piston components: a piston shaft 26 and piston sleeve 28. The piston shaft 26, the engine piston 22 and the exhaust/intake piston are a single cast, or otherwise formed, unit. The piston sleeve 28 surrounds the piston shaft 26 so that it can easily slide in both directions along the shaft while preventing fluid intrusion using seals between the shaft and sleeve. The piston sleeve 28, the power piston and compression piston are a single cast, or otherwise formed, unit. During operation, the top of the piston sleeve 28 presses against the underside of the engine piston 22 but is not connected to it. In this manner the engine piston 22 can drive or be driven by any of the three fluid pistons 33, 35, 37. The interface between the top of the piston sleeve 28 and the underside of the piston 22 on piston shaft 26 is shown schematically. It would be advantageous to configure the sleeve 28 and piston 22 so that the forces on the piston from the sleeve are distributed to reduce wear and tear on the piston at its center. A piston shaft position sensor 43 is fixed to the piston shaft, and likewise a piston sleeve position sensor 42 is fixed to the piston sleeve 28. Signals from these position sensors provide the SCC with engine component positions.

The engine piston shown in FIG. 5 is at TDC at the beginning of a power stroke. The power piston 33 develops most of the output power delivered by the LFE 20 during the power stroke. When the engine piston 22 is driven downward by combustion of fuel, and for example, fresh air within the cylinder 24, the power piston exerts pressure on fluid in the power cylinder 32 to drive fluid out of cylinder through fluid line 52. The pistons 35 and 37 deliver a smaller amount of power output through fluid lines 54 and 56. The pressurized fluid is used to drive fluid motors or fluid actuators in a vehicle, machine or for other applications. The compression piston 35 and exhaust/intake piston 37 are also driven downward by the engine piston 22 during the power stroke until they all reach the selected BDC as shown in FIG. 6. Any of the fluid pistons (33, 34, or 35) may be involved in establishing the selected BDC. The power and compression pistons are controlled by fluid valves and remain in this position until the beginning of the compression stroke.

Once the piston assembly has reached the selected BDC after the power stroke, the exhaust stroke occurs. FIG. 7 shows the engine piston 22 at TDC at the end of the exhaust stroke. The engine piston 22 was driven to this position by the exhaust/intake piston 37 which was acted upon by fluid flowing into the exhaust/intake cylinder 36 through fluid line 56 and out of the cylinder through line 55. The combustion gases were exhausted through the exhaust port through the exhaust valve 61. The engine piston 22 is then driven downward to BDC by the exhaust/intake piston under the control of fluid flowing through lines 55 and 56. Throughout the exhaust and intake strokes, the power and compression pistons remain in the position shown in FIGS. 6 and 7.

After the intake stroke, the pistons are in the positions shown in FIG. 6. To compress the fresh air and fuel in the cylinder 24, the compression piston 35 drives the engine piston 22 through the compression stroke to TDC as shown in FIG. 5. The piston 37 may also be used in the compression stroke to a lesser extent. Control valves (not shown) allow low or zero pressure fluid to flow into the power piston through line 52. Line 51 is vented. The pistons are now in position for the power stroke and the cycle is complete. During this complete cycle, the SCC has full control of the timing of the exhaust and intake valves 61, 63.

Figure 8:
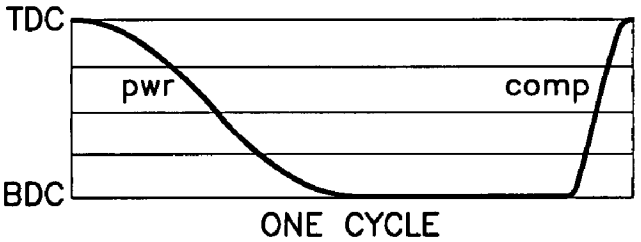
FIG. 8 is a graphic depiction of the position of a primary fluid piston during one cycle of a LFE constructed in accordance with an embodiment of the present invention.
Figure 9:
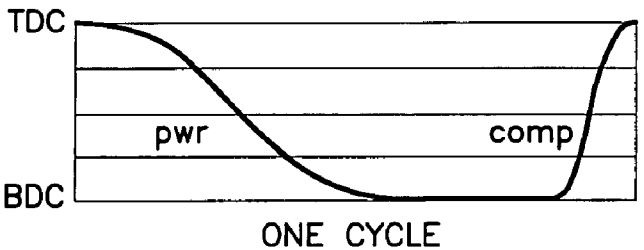
FIG. 9 is a graphic depiction of the position of a secondary fluid piston during one cycle of a LFE constructed in accordance with an embodiment of the present invention.
Figure 10:
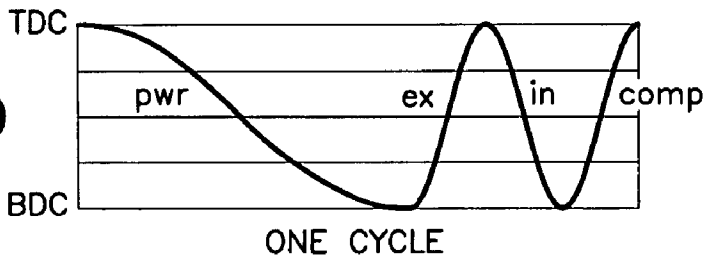
FIG. 10 is a graphic depiction of the position of a tertiary fluid piston during one cycle of a LFE constructed in accordance with an embodiment of the present invention.

FIGS. 8, 9, and 10 are graphic depictions of the position of the power, compression, and exhaust/intake pistons, respectively, during one cycle of the LFE shown in FIGS. 5-7. At this time, the exact shape of the power curve for a free-floating piston is estimated.

As shown in FIG. 10, the smaller double acting tertiary fluid piston may cycle faster than the engine piston 22 or the compression piston 33.

Figure 11:
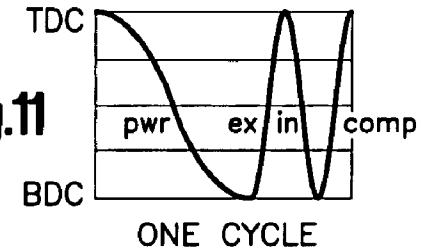
FIG. 11 is a graphic depiction of the position of an engine piston during one cycle of a LFE constructed in accordance with an embodiment of the present invention.
Figure 12:
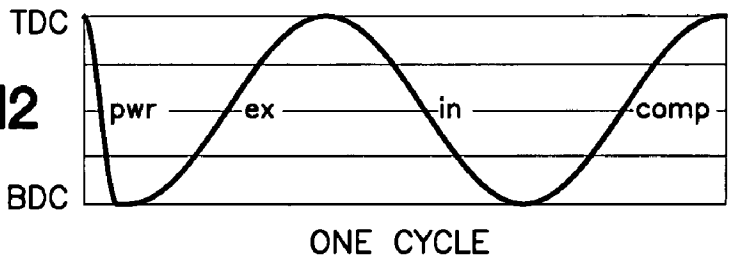
FIG. 12 is a graphic depiction of the position of an engine piston during one cycle of a LFE constructed in accordance with an embodiment of the present invention.

One advantage of the LFE is the flexibility of its operation since many operating parameters can be adjusted through software control and are not limited by mechanically interlocked components. FIGS. 11 and 12 depict one cycle of the engine piston when the LFE is operated at two different configurations. FIG. 11 shows one cycle where the power stroke is a larger part of the cycle than the exhaust, intake or compression strokes. FIG. 12 shows one cycle where the power stroke is a smaller part of the cycle than the exhaust, intake or compression strokes. These are just two examples of operating configurations for the LFE.

Not all four parts of the intervals of the cycle need to be the same, in an LFE with multiple cylinders, vibration can be reduced by adjusting the cycle as described below. Input data from a vibration sensor may result in situations where the SCC system will independently adjust the cycle intervals of each cylinder to maintain zero vibration.

If the fuel/air mixture is changed during the intake stroke, the SCC can adjust the fluid valves in the fluid lines and shorten the stroke by moving to a different BDC. This can occur while the LFE is running if warranted. The top and bottom of the arc of a crankshaft in a ICE provides a gentle controlled change of direction to the engine piston. In the LFE the SCC will accomplish this same effect by controlling the fluid valves in the appropriate fluid cylinder lines.

Figure 13:
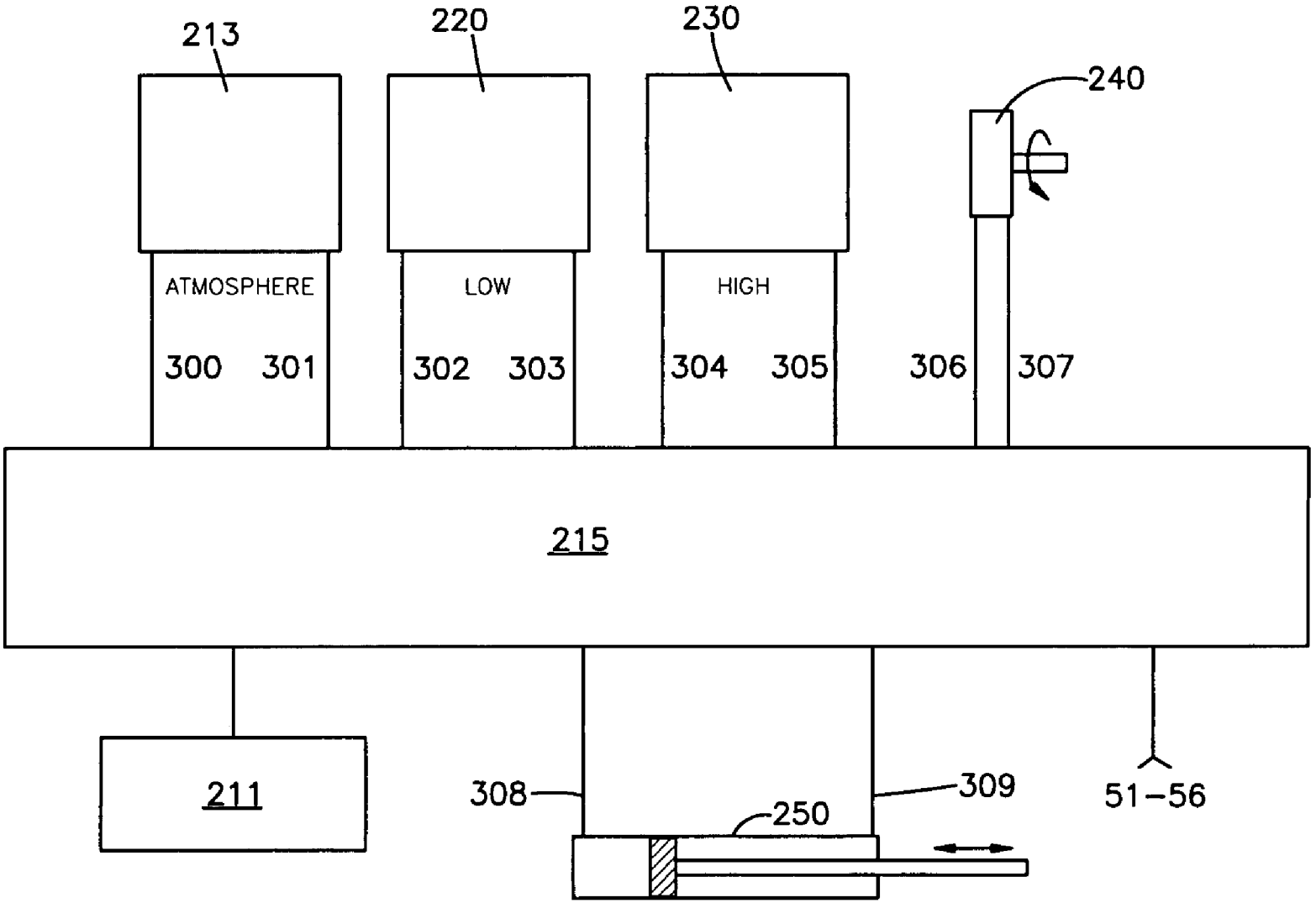
FIG. 13 is a representation of the hardware associated with a LFE constructed in accordance with an embodiment of the present invention.

FIG. 13 schematically illustrates an LFE SCC controller 211 that controls a manifold 215 that routes fluid between three fluid pressure storage tanks, LFE components, and fluid power output devices. In the described embodiment, a zero or atmospheric pressure tank 213, a low-pressure tank 220 and a high-pressure tank 230 are used. The SCC controls the operation of the tanks, the flow of fluid to the fluid motors 240 and/or fluid pistons 250 and the fluid used for LFE cooling. The SCC controller may periodically cause the manifold 215 to transfer fluid between fluid storage tanks depending on the LFE operating requirements. For example, fluid may be routed from the high-pressure tank along lines 51-56 to drive the compression and exhaust/intake pistons during engine start. Other LFE operating conditions that would require rerouting of fluid include running, stopping, and restarting. Fluid lines 300-309 transport fluid to and from the various components.

Figure 14:
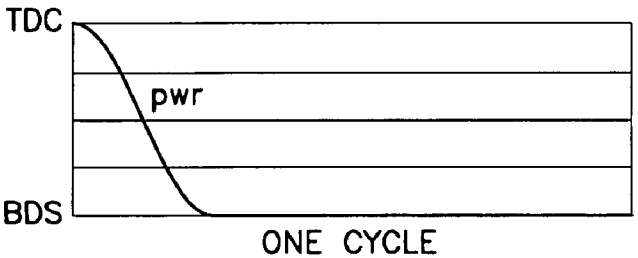
FIG. 14 is a graphic depiction of the position of the primary fluid piston during one cycle of a LFE constructed in accordance with an embodiment of the present invention.
Figure 15:
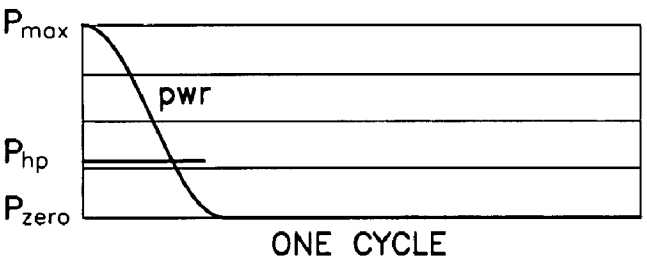
FIG. 15 is a graphic depiction of the fluid pressure produced by the primary fluid piston (with no backpressure) during one cycle of a LFE constructed in accordance with an embodiment of the present invention.

The pressure within power piston/cylinder assembly needs consideration when determining the operating cycle of the LFE. FIG. 14 shows a power piston position during one cycle. FIG. 15 represents the fluid pressure that the power piston could theoretically produce during one cycle with no backpressure. The pressure is $P_{max}$ at TDC and $P_{zero}$ at the selected BDC. The PV-Curve is diagrammatic.

The fluid pressure developed by the power piston can force fluid into a high-pressure tank only when its pressure is greater than the tank pressure. If the tank pressure were at $P_{hp}$ as shown in FIG. 15 the engine and all fluid pistons would stop their downward movement at this pressure. Even though there was combustion pressure above the engine piston, fluid would cease to flow into the high-pressure tank.

There are operations that need to occur during of each cycle of the LFE such as the operation of the intake and exhaust stroke of the engine piston that do not require much force to accomplish. Fluid for these types of operations and possibly fans for cooling the LFE, etc may utilize fluid from the low-pressure tank 220 (FIG. 13).

Figure 16:
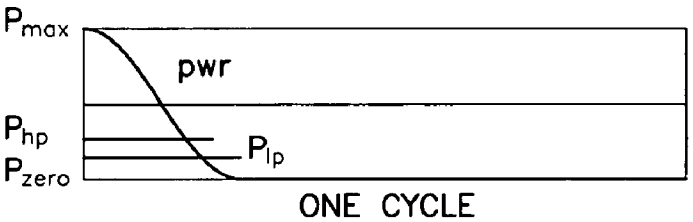
FIG. 16 is a graphic depiction of the fluid pressure produced by the primary fluid piston during one cycle of a LFE constructed in accordance with an alternative embodiment of the present invention.

Shown in FIG. 16 are two pressure points that represent the minimum pressure in a high-pressure tank $P_{hp}$ and the minimum pressure in a low-pressure tank $P_{lp}$. The third tank 213 as noted earlier is a zero or atmospheric pressure tank that acts as a reservoir for the fluid return line from fluid valves, motors, and the reverse side of a piston under compression, etc.

In FIG. 16, the SCC controls the fluid valves and directs fluid to the proper fluid tank. Fluid with a pressure between $P_{max}$ and $P_{hp}$ is fed into the high-pressure fluid tank. Fluid with a pressure between $P_{hp}$ and $P_{lp}$ is fed into the low-pressure fluid tank. Fluid with a pressure between $P_{lp}$ and $P_{zero}$ is fed into the zero or atmospheric pressure fluid tank. The graph labels indicate the fluid pressure tanks where the various fluid pressures are directed by valves controlled by the SCC.

Figure 20:
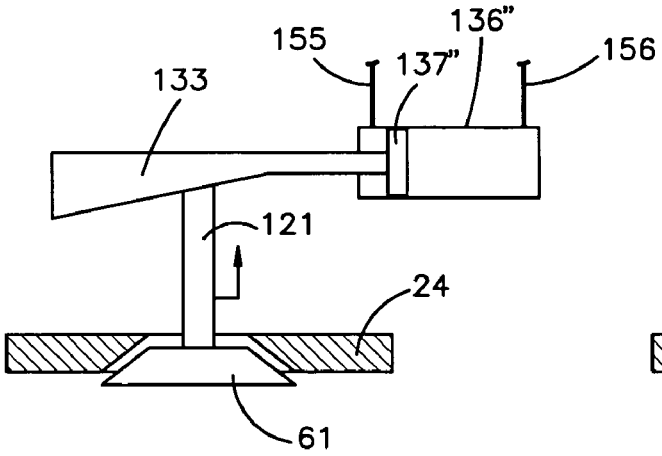
FIG. 20 is a schematic illustration of a valve that can be used as part of a cylinder assembly of a LFE constructed in accordance with an alternative embodiment of the present invention.
Figure 21:
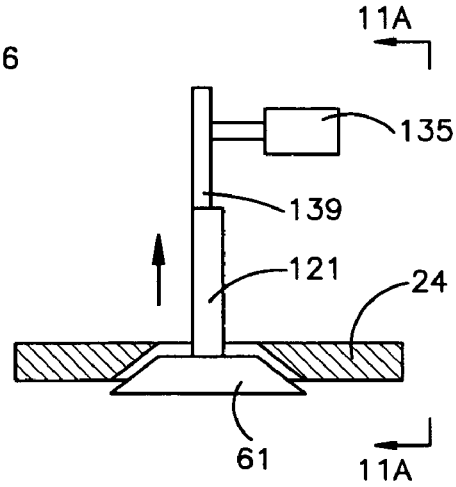
FIGS. 21 and 21*a* are schematic illustrations of a valve that can be used as part of a cylinder assembly of a LFE constructed in accordance with an alternative embodiment of the present invention.

The fluid tanks, the SCC and appropriate fluid control valves allow the engine and all three fluid pistons to function between TDC and the selected BDC as shown in FIG. 21. The pressure selected for $P_{hp}$ and $P_{lp}$ in FIGS. 20 and 21 should not be exceeded. At times it may be necessary for the SCC to transfer fluid between tanks. It may also be desirable or necessary for the SCC to shutdown the LFE and restart it when power output is required.

Another advantage to the LFE is that the SCC algorithm can reduce vibration using the momentum of other fluid cylinders. Four LFE cylinders can be mounted inline or in a square. For the inline version, adjacent cylinders move in opposite directions to each other in a near opposite interval of the cycle (pwr, ex, in and comp.) In a square configuration the cylinders in all four faces of the perimeter are moving in opposite directions to each other in a near opposite interval of the cycle (pwr, ex, in and comp.) For example, an eight cylinder LFE can consist of two adjacent inline four cylinder units where diagonally opposite cylinders are in the same interval of the cycle.

Whether the engine has a square or an inline cylinder configuration the cylinder heads are all connected together like a conventional engine. The fluid piston I/O lines would be close together requiring shorter lines and minimizing fluid power losses.

These examples indicate how a majority of the vibration of the LFE can be reduced. Since not all four parts of the cycle intervals of each engine cylinder need to be the same length in time, input data from a vibration sensor can cause the SCC program to independently adjust the individual cycle intervals of each cylinder to maintain zero vibration.

A further advantage of the LFE is that is can be operated with a wide variety of combustion fuels. The SCC program can be flexible enough to allow the LFE to adapt to a wide variety of fuels, fuel grades and types of fuel by, for example, changing piston velocity during the power stroke. Lower cost low octane petroleum fuels or new fuels being developed could be useful in the LFE. This is because the SCC independently controls all components of the LFE. An energy source that is a combination of a fuel and oxidizer would be ideal fuel for the LFE. It would need only a power and exhaust stroke.

Control of the Intake and Exhaust Valves

FIGS. 18-21*a* illustrate four possible examples for controlling the intake and exhaust valves of a conventional ICE or a LFE using a fluid cylinder or a stepper (or equivalent) motor and an SCC. The SCC controls operation of a valve control piston 137 in a valve control cylinder 136 by controlling fluid flow through lines 155, 156. This will allow the continuous varying of the valve timing events and their duration. As can be seen in FIGS. 18-21*a*, there may or may not be valve lifters, pushrods and rocker arms depending on the final design.

The valve system configurations shown in FIGS. 18-21 allow for precise control of the opening and closing of each engine valve. The purpose is to increase performance, efficiency and minimize atmospheric pollutants. Current ICE designs have fixed valve timing events and duration because of the camshaft lobe.

Using a fluid cylinder or a stepper (or equivalent) motor and an SCC allows for independent control of the intake and exhaust valves, including the timing, speed of motion, and duration of opening. The proper timing for these events to occur is based on the engine cycle.

While the valve control systems shown in FIGS. 18-21*a* are described as part of the LFE system, they can be used advantageously with future conventional ICE designs. The SCC can process inputs such as the position and velocity of the pistons, ambient temperature, humidity, and barometric pressure, engine torque, carburetor airflow, exhaust gas composition, etc. to determine the operating parameters for the exhaust and intake valves and fuel mixture.

The SCC maximizes the performance of the LFE or the modified ICE and to minimize atmospheric pollution.

Figure 18:
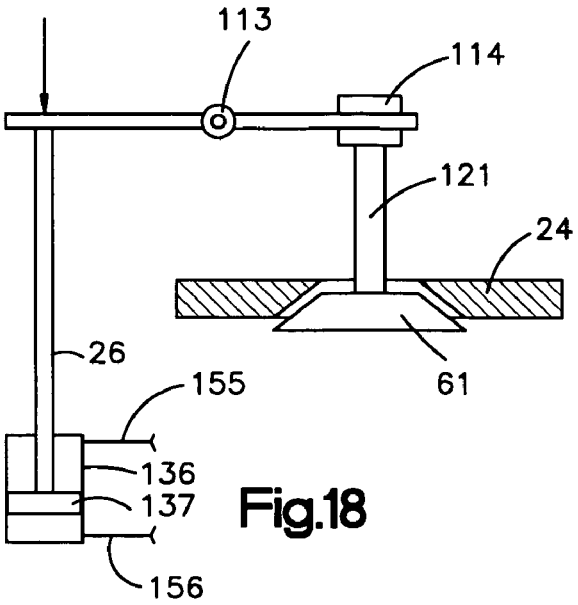
FIG. 18 is a schematic illustration of a valve that can be used as part of a cylinder assembly of a LFE constructed in accordance with an embodiment of the present invention.

The valve system shown in FIG. 18 includes a pivoting rocker arm 113 connected to a valve stem 121 and a with connection point 114. The valve control piston 137, under the control of the SCC, activates the rocker arm in lieu of the camshaft. All other components of a normal valve system could be unchanged.

Figure 19:
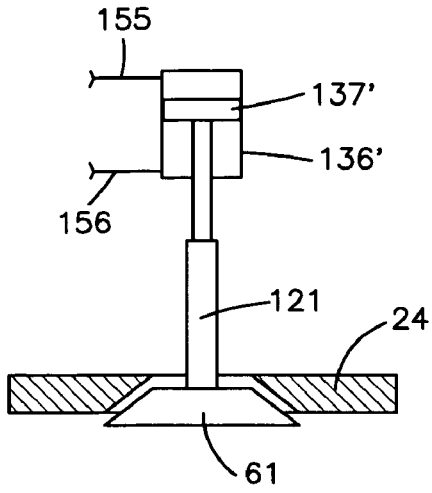
FIG. 19 is a schematic illustration of a valve that can be used as part of a cylinder assembly of a LFE constructed in accordance with an alternative embodiment of the present invention.

The valve system shown in FIG. 19 includes a valve control cylinder 136' that is directly controlling the valve 61. Similarly, the valve 63 can be controlled according to the systems shown in FIGS. 18-21. The SCC controls the fluid valves that position the valve control piston 137' into its proper position.

The valve system shown in FIG. 20 includes a valve control piston 137" and a sliding cam 133 and is controlled by the SCC. The sliding cam is positioned to operate the valve 61 into its proper position during the engine cycle. Upward tension is applied on the valve in the direction indicated by the arrow.

Figure 21A:
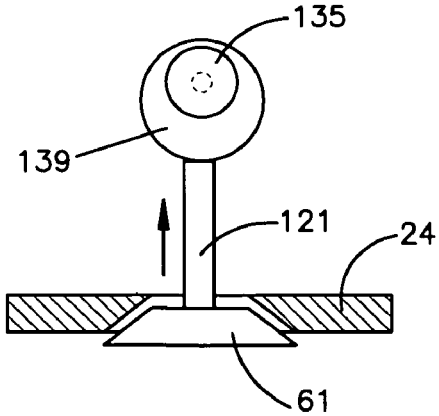

The valve system shown in FIG. 21 includes a stepper (or equivalent) motor 135 driving a cam or disk 139 shown also in FIG. 21*a*. The shaft position and speed of rotation of the motor is controlled the SCC. This positions the valve 61 into its proper position during the engine cycle. The valve control disk could have a cam lobe shape or a ramp shape on its edge. The stepper motor could oscillate the cam lobe shape or ramp shape back and forth. Upward tension is applied on the valve in the direction indicated by the arrow. The valve motion occurs over this region of the cam and maintains the engine valve in its proper position during the cycle.

A modified ICE can achieve some of the benefits reaped by the LFE using these valve control systems.

While the invention has been described with a degree of particularity, it is the intent that the invention includes all modifications and alterations from the disclosed design falling within the spirit or scope of the appended claims.

We claim:

1. A linear fluid engine comprising:

one or more accumulating tanks for holding pressurized fluid within various predetermined ranges of pressures;

one or more engine pistons housed within a combustion chamber, each engine piston comprising an engine piston shaft and an engine piston head;

a fluid power piston corresponding to each engine piston, the power piston being housed within a power piston cylinder and including a power piston head and a power piston shaft, the power piston being positioned in-line with the engine piston such that the power piston shaft has an axial centerline that is substantially coincident with an axial centerline of the engine piston shaft; wherein the power piston is driven by movement of the engine piston caused by combustion of fuel in the combustion chamber and wherein when the power piston is driven by the engine piston the power piston acts upon fluid within the power piston cylinder to transfer power from the combustion chamber to the proper accumulator tanks;

a fluid compression piston coupled to the engine piston, the compression piston being housed in a compression piston cylinder and including a compression piston head and compression piston shaft, the compression piston being positioned in-line with the engine and power pistons and wherein the compression piston is powered by fluid power from the proper accumulator tanks to drive the engine piston within the combustion chamber to compress fuel in preparation for a next combustion cycle;

an intake/exhaust piston coupled to the engine piston, the intake/exhaust piston being housed in a intake/exhaust piston cylinder and including a intake/exhaust piston head and intake/exhaust piston shaft, the intake/exhaust piston being positioned in-line with the engine and power pistons and wherein the intake/exhaust piston is powered by fluid power from the proper accumulator tanks to drive the engine piston within the combustion chamber to exhaust combustion gases and take in fresh air in preparation for the next combustion cycle;

wherein the power piston and compression piston are formed on a moveable sleeve disposed around the engine piston shaft that sealingly engages the engine piston shaft and wherein the sleeve includes a top distal end that is configured to abut an underside of the engine piston head to drive or be driven by the engine piston; and wherein the intake/exhaust piston is formed on the engine piston shaft.

2. The linear fluid engine of claim 1 comprising:

a plurality of fluid valves that regulate fluid flow into, out of, and between the accumulating tanks; and a controller that actuates the fluid valves to maintain each accumulator tank within a predetermined pressure range and to selectively power linear fluid engine pistons and external devices according to a linear fluid engine control algorithm stored in controller memory.

3. The linear fluid engine of claim 2 comprising one or more position sensors that send signals indicative of engine and power piston position to the controller.

4. The linear fluid engine of claim 2 wherein the controller actuates one or more linear fluid engine components to control a power piston velocity when the power piston is driven by the engine piston.

5. The linear fluid engine of claim 4 wherein the power piston velocity varies as a function of power piston position.

6. The linear fluid engine of claim 2 wherein the controller actuates one or more linear fluid engine components to control a power piston stroke length when the power piston is driven by the engine piston.

7. A linear fluid engine comprising:

an engine cylinder that houses an engine piston within a combustion chamber;

a fluid power piston coupled to the engine piston and housed within a power piston cylinder, the power piston being driven by movement of the engine piston caused by the combustion of fuel in the combustion chamber; and wherein when the power piston is driven by the engine piston the power piston acts upon fluid within the power piston cylinder to transfer power from the engine cylinder out of the linear fluid engine; and one or more position sensors that provide signals indicative of the position of the engine piston and the power piston.

8. A linear fluid engine comprising:

an engine cylinder that houses an engine piston within a combustion chamber;

a fluid power piston coupled to the engine piston and housed within a power piston cylinder, the power piston being driven by movement of the engine piston caused by the combustion of fuel in the combustion chamber; and wherein when the power piston is driven by the engine piston the power piston acts upon fluid within the power piston cylinder to transfer power from the engine cylinder out of the linear fluid engine; and wherein the engine piston comprises an engine piston head and an engine piston shaft and the power piston comprises a power piston head and a power piston shaft; and wherein the power piston head and shaft are formed on a moveable sleeve disposed around the engine piston shaft that sealingly engages the engine piston shaft.

9. The linear fluid engine of claim 8 wherein the sleeve comprises a top distal end that is configured to abut an underside of the engine piston head to drive or be driven by the engine piston.

10. A linear fluid engine comprising:

an engine cylinder that houses an engine piston within a combustion chamber;

a fluid power piston coupled to the engine piston and housed within a power piston cylinder, the power piston being driven by movement of the engine piston caused by the combustion of fuel in the combustion chamber; and wherein when the power piston is driven by the engine piston the power piston acts upon fluid within the power piston cylinder to transfer power from the engine cylinder out of the linear fluid engine; and a controller that actuates one or more linear fluid engine components based on a linear fluid engine control algorithm that is stored in controller memory.

11. The linear fluid engine of claim 10 further comprising a fluid compression piston coupled to the engine piston that drives the engine piston within the combustion chamber to compress fuel in preparation for the combustion of the fuel within the combustion chamber and wherein the controller actuates the compression piston by supplying proper fluid pressure to the compression piston.

12. The linear fluid engine of claim 10 wherein the controller receives signals indicative of engine piston and power piston position from one or more position sensors.

13. A linear fluid engine comprising:

an engine cylinder that houses an engine piston within a combustion chamber;

a fluid power piston coupled to the engine piston and housed within a power piston cylinder, the power piston being driven by movement of the engine piston caused by the combustion of fuel in the combustion chamber; and wherein when the power piston is driven by the engine piston the power piston acts upon fluid within the power piston cylinder to transfer power from the engine cylinder out of the linear fluid engine; and wherein the combustion chamber includes at least one valve that selectively places the combustion chamber in communication with ambient pressure and wherein the valve is actuated by fluid power generated by the power piston.

14. A linear fluid engine comprising:

an engine cylinder that houses an engine piston within a combustion chamber;

a fluid power piston coupled to the engine piston and housed within a power piston cylinder, the power piston being driven by movement of the engine piston caused by the combustion of fuel in the combustion chamber; and wherein when the power piston is driven by the engine piston the power piston acts upon fluid within the power piston cylinder to transfer power from the engine cylinder out of the linear fluid engine; and wherein the combustion chamber includes at least one valve that selectively places the combustion chamber in communication with ambient pressure and wherein the valve is actuated by a stepper motor.

15. The linear fluid engine of claim 13 comprising a controller that actuates one or more linear fluid engine components based on a linear fluid engine control algorithm to actuate the at least one valve on the combustion chamber.

16. The linear fluid engine of claim 14 comprising a controller that controls the operation of the stepper motor based on a linear fluid engine control algorithm to actuate the at least one valve on the combustion chamber.

17. The linear fluid engine of claim 10 further comprising:

one or more accumulating tanks in fluid communication with the power piston that are each maintained within a predetermined range of pressures; and wherein the controller controls one or more linear fluid engine components to maintain each of the one or more accumulating tanks within a range of appropriate pressures.

18. The linear fluid engine of claim 17 wherein the linear fluid engine control algorithm actuates one or more linear fluid engine components to route fluid between the power piston cylinder and the one or more accumulating tanks.

19. The linear fluid engine of claim 10 wherein the controller actuates one or more linear fluid engine components to control a power piston velocity when the power piston is driven by the engine piston.

20. The linear fluid engine of claim 17 wherein the power piston velocity varies as a function of power piston position.

21. The linear fluid engine of claim 10 wherein the controller actuates one or more linear fluid engine components to control a power piston stroke length when the power piston is driven by the engine piston.

22. A method for powering engine driven components with a power transferring fluid comprising:

combusting fuel in an engine cylinder with an engine piston;

driving a power piston with the power generated by the combustion of fuel in the engine cylinder to pressurize the power transferring fluid;

storing the pressurized power transferring fluid in one or more accumulating tanks;

with the pressurized power transferring fluid, driving a compression piston that is coupled to the engine piston to compress fuel for a subsequent combustion of the fuel; and driving an intake/exhaust fluid piston with the pressurized power transferring fluid stored in the one or more accumulating tanks and wherein the intake/exhaust fluid piston drives one or more intake/exhaust valves on the engine cylinder that selectively place the engine cylinder in communication with ambient air.

23. A method for powering engine driven components with a power transferring fluid comprising:

combusting fuel in an engine cylinder with an engine piston;

driving a power piston with the power generated by the combustion of fuel in the engine cylinder to pressurize the power transferring fluid;

with the pressurized power transferring fluid, driving a compression piston that is coupled to the engine piston to compress fuel for a subsequent combustion of the fuel; and actuating one or more linear fluid engine components to control a power piston velocity when the power piston is driven by the engine piston.

24. The method of claim 23 wherein the power piston velocity varies as a function of power piston position.

25. A method for powering engine driven components with a power transferring fluid comprising:

combusting fuel in an engine cylinder with an engine piston;

driving a power piston with the power generated by the combustion of fuel in the engine cylinder to pressurize the power transferring fluid;

with the pressurized power transferring fluid, driving a compression piston that is coupled to the engine piston to compress fuel for a subsequent combustion of the fuel; and actuating one or more linear fluid engine components to control a power piston stroke length when the power piston is driven by the engine piston.

26. An apparatus for driving engine driven components with a pressurized power transferring fluid comprising:

means for combusting fuel in an engine cylinder with an engine piston;

means for driving a power piston with the power generated by the combustion of fuel in the engine cylinder to pressurize the power transferring fluid;

means for storing the pressurized power transferring fluid;

means for driving a compression piston that is coupled to the engine piston with the pressurized power transferring fluid to compress fuel for a subsequent combustion of the fuel; and means for driving an intake/exhaust fluid piston with the stored pressurized power transferring fluid and wherein the intake/exhaust fluid piston drives one or more intake/exhaust valves on the engine cylinder that selectively place the engine cylinder in communication with ambient air.

27. An apparatus for driving engine driven components with a pressurized power transferring fluid comprising:

means for combusting fuel in an engine cylinder with an engine piston;

means for driving a power piston with the power generated by the combustion of fuel in the engine cylinder to pressurize the power transferring fluid;

means for driving a compression piston that is coupled to the engine piston with the pressurized power transferring fluid to compress fuel for a subsequent combustion of the fuel; and means for controlling a power piston velocity when the power piston is driven by the engine piston.

28. An apparatus for driving engine driven components with a pressurized power transferring fluid comprising:

means for combusting fuel in an engine cylinder with an engine piston;

means for driving a power cylinder with the power generated by the combustion of fuel in the engine cylinder to pressurize the power transferring fluid;

means for driving a compression piston that is coupled to the engine piston with the pressurized power transferring fluid to compress fuel for a subsequent combustion of the fuel; and means for controlling a power piston stroke length when the power piston is driven by the engine piston.

* * * * *